US010287654B2

(12) United States Patent
Hardy et al.

(10) Patent No.: US 10,287,654 B2
(45) Date of Patent: May 14, 2019

(54) NI-BASE ALLOY FOR STRUCTURAL APPLICATIONS

(71) Applicant: ROLLS-ROYCE plc, London (GB)

(72) Inventors: Mark C Hardy, Derby (GB); Howard J Stone, Derby (GB); Nicholas G Jones, Derby (GB); Paul M Mignanelli, Derby (GB)

(73) Assignee: ROLLS-ROYCE PLC, London (GB)

( * ) Notice: Subject to any disclaimer, the term of this patent is extended or adjusted under 35 U.S.C. 154(b) by 383 days.

(21) Appl. No.: 15/190,502

(22) Filed: Jun. 23, 2016

(65) Prior Publication Data

US 2017/0022586 A1 Jan. 26, 2017

(30) Foreign Application Priority Data

Jul. 20, 2015 (GB) ..... 1512692.3

(51) Int. Cl.
*C22C 19/05* (2006.01)

(52) U.S. Cl.
CPC ..... *C22C 19/058* (2013.01); *C22C 19/05* (2013.01); *C22C 19/055* (2013.01); *C22C 19/056* (2013.01)

(58) Field of Classification Search
CPC ..... C22C 19/055; C22C 19/056
See application file for complete search history.

(56) References Cited

U.S. PATENT DOCUMENTS

| | | | |
|---|---|---|---|
| 3,046,108 | A | 7/1962 | Eiselstein |
| 3,972,752 | A | 8/1976 | Honnorat et al. |
| 4,788,036 | A | 11/1988 | Eiselstein et al. |
| 4,981,644 | A | 1/1991 | Chang |
| 7,527,702 | B2 | 5/2009 | Cao et al. |

FOREIGN PATENT DOCUMENTS

| | | | |
|---|---|---|---|
| EP | 1197570 | A2 | 4/2002 |
| EP | 2083097 | A1 | 7/2009 |
| EP | 2770081 | A2 | 8/2014 |
| EP | 2805784 | A1 | 11/2014 |
| GB | 961525 | A | 6/1964 |
| SU | 449964 | A1 | 11/1974 |
| SU | 287791 | A1 | 12/1976 |
| WO | 2014/124626 | A1 | 8/2014 |

OTHER PUBLICATIONS

Nov. 23, 2016 Search Report issued in European Patent Application No. 16175973.

(Continued)

*Primary Examiner* — Jessee R Roe

(74) *Attorney, Agent, or Firm* — Oliff PLC

(57) ABSTRACT

A nickel-base alloy of, in atomic percent unless otherwise stated, up to 8 percent Fe, up to 16 percent Co, between 15 and 25 percent Cr, up to 3 percent Mo, up to 2 percent W, between 3 and 5 percent Al, between 3 and 7.5 percent Nb, up to 3 percent Ta, up to 0.2 percent Ti, up to 0.5 percent C, up to 0.175 percent B, up to 0.07 percent Zr, up to 1 percent Mn, up to 1 percent Si, up to 0.2 percent Hf, the balance of Ni and incidental impurities, wherein the atomic ratio of Al to Nb is between 0.4 and 1.7, the atomic ratio of the sum of Al and Ti to Nb is between 0.4 and 1.8, and, the composition including at least 10 percent of elements from the group of Al, Nb, and Ti.

16 Claims, 4 Drawing Sheets

(56) References Cited

OTHER PUBLICATIONS

Tien, J.K. et al., "Raising the High Temperature Limit of IN718—Designing Ticolloy," Proceedings of the 1990 High Temperature Materials for Power Engineering Conference, pp. 1341-1356, (1990).
Mignanelli, P.M et al., "The influence of Al:Nb ratio on the microstructure and mechanical response of quaternary Ni—Cr—Al—Nb alloys," Materials Science & Engineering, vol. 612, (2014), pp. 179-186.
Inspec Accession No. 3734034 & Physics of Metals and Metallography, EE Novikova, "Cellular precipitation in a multiphase alloy of the Ni—Cr—Nb—Fe—Al system."
Inspec Accession No. 3767579 & Physics of Metals and Metallography, EE Novikova, "Mechanisms and kinetics of the gamma->gamma+gamma"-> gamma +beta transformation on an alloy based on the Ni—Cr—Nb—Fe—Al system.
May 17, 2016 Search Report issued in British Patent Application No. 1512692.3.
R.F. Decker. Strengthening mechanisms in nickel-base superalloys. In Steel strengthening mechanisms symposium, 1969.
Paulonis et al., Precipitation in nickel-base alloy 718, ASM Transactions Quaterly, vol. 62, No. 3, p. 611-622, 1969.
S. Fu et al., Research on Inconel 718 type alloys with improvement of temperature capability. Superalloys 718, 625, 106 and derivatives, p. 281-296, 2010.
R. Cozar et al., Morphology of y' and y precipitates and thermal stability of Inconel 718 type alloys. Metallurgical transactions, vol. 4, p. 47-59, 1973.
Guo, et al., Comparison of y'/y precipitates and mechanical properties in modified 718 alloys. Superalloys 718, 625, 106 and derivatives, p. 397-408, 1991.
J.M. Oblak, et al., Coherency strengthening in Ni base alloys hardened by D022 y precipitates. Metallurgical Transactions, vol. 5, p. 143-153, 1974.
S. Mannan et al., Time-temperature-transformation diagram of alloy IN725, Superalloys 718, 625, 706 and derivatives, p. 345-356, 2001.
Wlodek et al., The structure of Rene 220C, TMS Superalloys, p. 477-486, 1992.

Table1

| At.% | Broad | Narrow |
|---|---|---|
| Ni | bal. | bal. |
| Fe | 0-8 | 0-1.5 |
| Co | 0-16 | 0-4 |
| Cr | 15-25 | 17-22 |
| Mo | 0-3 | 1-2 |
| W | 0-2 | 0-1 |
| Al | 3-5 | 3.5-4.5 |
| Nb | 3-7.5 | 5-6.5 |
| Ta | 0-3 | 0-2 |
| Ti | 0-0.2 | 0-0.2 |
| C | 0-0.5 | 0-0.4 |
| B | 0-0.175 | 0-0.175 |
| Zr | 0-0.07 | 0-0.07 |
| Mn | 0-1 | 0-1 |
| Si | 0-1 | 0-1 |
| Hf | 0-0.2 | 0-0.2 |

FIG. 6

Table2:

| | at.% | | | | | | | | | |
|---|---|---|---|---|---|---|---|---|---|---|
| Alloy #. | Ni | Fe | Co | Cr | Mo | W | Al | Nb | Ti | Ta |
| 1 | bal. | | | 15 | | | 4 | 6 | | |
| 2 | bal. | | | 17 | | | 4 | 6 | | |
| 3 | bal. | | | 21 | | | 4 | 6 | | |
| 4 | bal. | | | 25 | | | 4 | 6 | | |
| 5 | bal. | | | 15 | | | 3 | 4.5 | | |
| 6 | bal. | | | 15 | | | 5 | 7.5 | | |
| 7 | bal. | | | 15 | 1 | | 4 | 6 | | |
| 8 | bal. | | | 15 | 2 | | 4 | 6 | | |
| 9 | bal. | | | 15 | | 1 | 4 | 6 | | |
| 10 | bal. | | | 15 | | 2 | 4 | 6 | | |
| 11 | bal. | 4 | | 15 | | | 4 | 6 | | |
| 12 | bal. | 8 | | 15 | | | 4 | 6 | | |
| 13 | bal. | | 4 | 15 | | | 4 | 6 | | |
| 14 | bal. | | 8 | 15 | | | 4 | 6 | | |
| 15 | bal. | | 12 | 15 | | | 4 | 6 | | |
| 16 | bal. | | 16 | 15 | | | 4 | 6 | | |
| 17 | bal. | | | 15 | | | 4 | 6 | 1 | |
| 18 | bal. | | | 15 | | | 3 | 6 | 1 | |
| 19 | bal. | | | 15 | | | 2 | 6 | 2 | |
| 20 | bal. | | | 15 | | | 1 | 6 | 3 | |
| 21 | bal. | | | 15 | | | 4 | 6 | | 1 |
| 22 | bal. | | | 15 | | | 4 | 6 | | 2 |
| 23 | bal. | | | 15 | | | 2 | 6 | | 2 |
| 24 | bal. | | | 15 | | | 4 | 4 | | 2 |

FIG. 7

NI-BASE ALLOY FOR STRUCTURAL APPLICATIONS

FIELD OF THE INVENTION

The present disclosure relates to nickel-base alloys, and particularly, although not exclusively, to alloys suitable for use in additive layer manufacture of components for gas turbine engines. In particular, the present disclosure relates to an age-hardenable nickel-chromium alloy comprising a dual superlattice γ-γ'-γ" microstructure.

BACKGROUND OF THE INVENTION

There is a continuing need for new and improved alloys that are suitable for high temperature structural components and casing applications in gas turbine engines. The requirement for new alloys is driven by the desire to operate gas turbine engines at higher temperatures and pressures to achieve increased fuel efficiency. Benefits may also be derived from new alloys with increased microstructural stability during service, enabling increased component life. In particular, new alloys with higher strength may allow designers to reduce wall thickness and/or component weight, thus leading to the ultimate benefits of reduced material usage and greater efficiency. In addition, there is a drive for improved alloys that are amenable to welding, repair, or production through additive manufacturing techniques.

One class of existing alloys amenable to welding and additive manufacture is the group of alloys commonly referred to as nickel-based superalloys that contain comparatively low volume fractions of reinforcing precipitates. Examples of such known alloys include, for example, Inconel 718 (IN718), Inconel 725 (IN725) and René 220.

As known in the art, IN718, as disclosed in U.S. Pat. No. 3,046,108, was designed to precipitate a distribution of gamma double prime (γ") precipitates along with a very small distribution of gamma prime (γ'). IN718 is known as a malleable nickel-chromium base alloy having a particularly high combination of strength, ductility and rupture strength at temperatures of up to 760° C. Consequently, developmental work on IN718 established a method by which the precipitates could be formed with a compact morphology consisting of a y cube with a layer of γ" covering all sides of the outer faces. As such, IN718 is commonly processed to produce a microstructure in which the γ" nucleate and grow from a fine dispersion of γ' precipitates formed at a higher temperature. This leads to a sandwich like morphology in which the γ' precipitates are enveloped by γ". This modification was reported to confer improved mechanical properties, as disclosed in U.S. Pat. No. 3,972,752.

Additionally, U.S. Pat. No. 7,527,702 describes a Nickel-base alloy known as Allvac 718Plus. Allvac 718Plus is a predominantly γ' strengthened alloy, which also precipitates a grain boundary phase: eta (η) ($Ni_3Ti$) or delta (δ) ($Ni_3Nb$). The Al is therefore the primary gamma prime forming element, but the Nb and Ti will also be present in the γ' and help to strengthen this phase.

Furthermore, U.S. Pat. No. 4,788,036 describes a Nickel-base alloy known as IN725, containing correlated percentages of chromium, iron, molybdenum, titanium, niobium and aluminium. IN725 is strengthened by γ" precipitates, with a small dispersion of γ'. This alloy was reported to possess good workability, high strength, ductility and resistance to both pitting and stress-corrosion cracking.

Accordingly, several other alloys, such as Ticolloy, have been developed to strike a balance between the γ', γ" and δ phases, tailoring them to meet the thermal, mechanical and microstructural stability requirements for varying industrial applications. In particular, Ticolloy is listed as having the same composition as IN718, but with a modified Al, Nb and Ti content [Tien et al., Proceedings of the 1990 High Ttemperature Materials for Power Engineering Conference, p1341-1356, 1990].

It is known that the ease with which superalloys may be fabricated, welded and thermo-mechanically processed decreases with increasing γ' volume fraction as rapid cooling does not suppress precipitation. This leads to lower ductility and increased susceptibility to cracking during processing. Those alloys that derive their strength from γ" have the benefit that the precipitates only form on slow cooling or subsequent heat treatment, thereby making the alloys more amenable to welding and thermo-mechanical processing.

Known γ" alloys, for example, IN718 and IN725 cannot provide the balance of properties needed for operating at temperature in excess of 650° C. for prolonged periods. In particular, IN718 and IN725 are prone to microstructural instability. In the case of IN718, this is associated with the formation of the δ phase at the expense of the strengthening γ" precipitates, leading to a loss of mechanical properties and unacceptably low component lives. In general, alloys of this type possess insufficient creep resistance, damage tolerance, environmental resistance and proof strength at temperatures in the range of 650° C. to 800° C. As such, they are not good candidates for service at peak temperatures above 650° C.

Accordingly, it is an aim of the present disclosure to provide an age-hardenable nickel-chromium alloy that possesses improved mechanical properties at high temperatures. It is also an aim of the invention to provide an alloy that may be used in conjunction with additive manufacturing and/or welding methods existing within the art.

SUMMARY OF THE INVENTION

The disclosure provides a nickel base alloy as set out in the claims.

BRIEF DESCRIPTION OF THE DRAWINGS

Preferred embodiments of the present disclosure will now be described, by way of example only, with reference to the accompanying drawings, in which:

FIG. 6 (Table 1) shows a table listing example alloy compositions, in accordance with embodiments of the present disclosure; and, FIG. 7 (Table 2) shows a table listing further compositions of alloys, in accordance with the present disclosure.

DETAILED DESCRIPTION OF THE PREFERRED EMBODIMENTS

Alloys of the present disclosure are designed to be age-hardenable nickel-chromium alloys reinforced by both γ' and γ" precipitates, which have superlattice structures of the γ matrix in which they reside. The composition ranges that define alloys according to the present disclosure are given in atomic percent (at. percent) in FIG. 6 (Table 1). Accordingly, FIG. 6 (Table 1) defines the composition ranges for the alloy, specified in both general and preferred compositional ranges.

Figure 1:
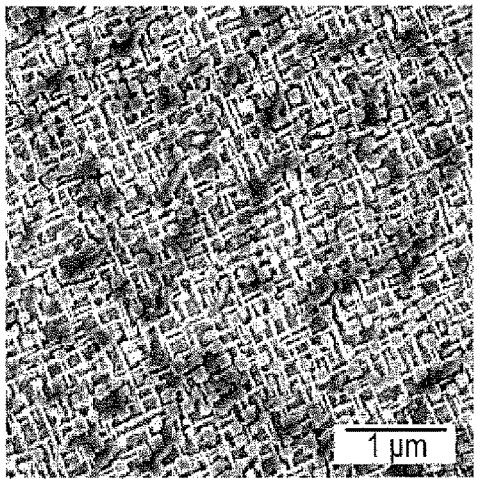
FIG. 1 shows a scanning electron micrograph showing an example of a dual superlattice γ-γ'-γ" microstructure after homogenisation and ageing heat treatment, of an alloy in accordance with the present disclosure.
Figure 2:
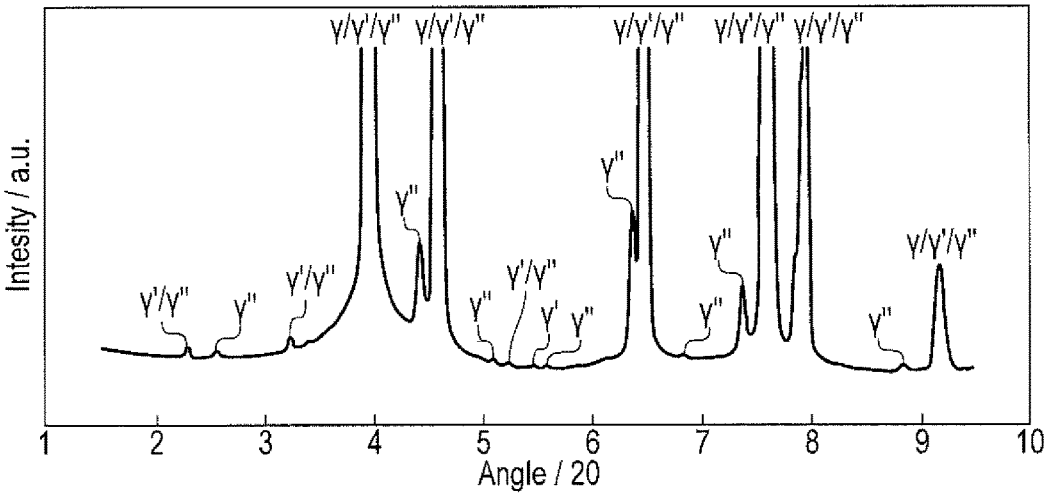
FIG. 2 shows X-ray diffraction data identifying the reflections from the superlattice precipitates, γ' and γ", of an alloy in accordance with the present disclosure.

FIG. 1 shows a scanning electron micrograph of an age-hardenable nickel-chromium alloy in accordance with the present disclosure. In particular, FIG. 1 shows a microstructure resulting from a composition of Ni-15Cr-4Al-6Nb (consisting of, in atomic percent 15 percent Cr, 4 percent Al, 6 percent Nb, the balance consisting of Ni and incidental impurities) as specified in accordance with the present disclosure. In particular, the described alloy as shown in FIG. 1 has been heat treated at 700° C. for 1000 hours, the microstructure comprising of a γ matrix with dispersion of γ' and γ" precipitates, the structures of the γ' and γ" precipitates being confirmed from observation of the superlattice reflections associated with these phases using X-ray diffraction, as shown in FIG. 2.

The strength benefits of γ" are well documented. However, the presence of γ' in the microstructure is an important factor in minimising the formation of δ, by stacking fault shear, as this would require a high energy complex stacking fault in the γ'. Consequently, the presence of both superlattice precipitates, γ and γ", may be found in other alloys. However, the high volume fraction of both γ' and γ" precipitated by alloys within the compositional range of the present disclosure is markedly different from alloys previously known within the art. In particular, in existing γ" reinforced alloys, the γ' forms in such a small proportion that it does not contribute significantly to the mechanical properties and behaviour of the alloy.

Accordingly, the precipitation of both γ' and γ", in view of the composition of the present disclosure, ensures a marked improvement in properties. Accordingly, the γ" phase has been found to provide the majority of the strengthening within the alloy, with a further contribution towards strengthening from the γ' phase. However, the γ' also aids in preventing the γ" phase from transforming into the δ phase during thermal exposure, the precipitation of which compromises the properties of the alloy. The two precipitates γ' and γ", in combination, are therefore required to provide a peak in performance, which cannot be achieved through the precipitation of a single precipitate.

Referring again to FIG. 1, the microstructure shown is markedly different from the morphology of precipitates of conventionally aged IN718, the compact morphology of precipitates comprising a γ' core with a layer of γ" across the faces.

Figure 3:
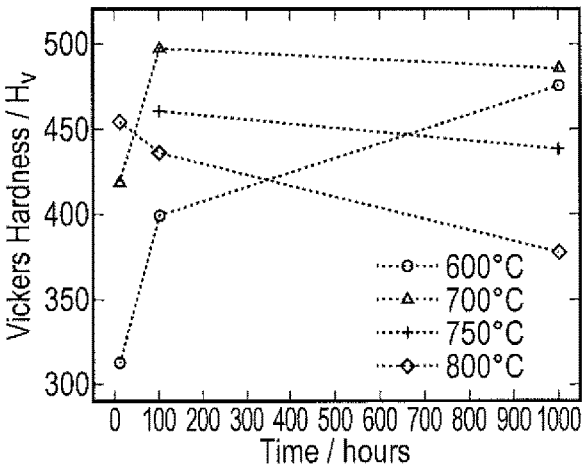
FIG. 3 shows a graph of the Vickers Hardness of an alloy of the present disclosure as a function of precipitate ageing heat treatment time demonstrating the age-hardening characteristics, in accordance with the present disclosure.

FIG. 3 shows the measured hardness of an alloy of the present disclosure as a function of heat treatment time and temperature. This data demonstrates that the microstructure obtained from alloys of the present disclosure are able to undergo age hardening. The data presented in FIG. 3 indicates that increased strength may be achieved through heat treatment, preferably although not exclusively, between the temperatures of 700 and 800° C. for between 100 and 10 hours respectively. As shown in FIG. 3, heat treatment of the alloys of the present disclosure using these treatment conditions may substantially increase the hardness, demonstrating the age-hardening characteristics of these alloys.

Figure 4:
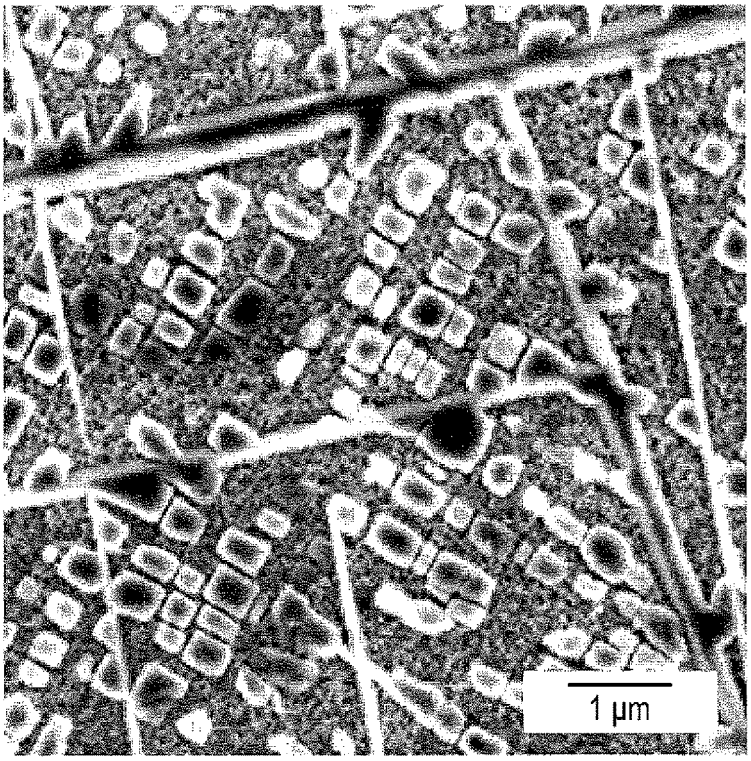
FIG. 4 shows a scanning electron micrograph of an alloy of the present disclosure showing a transformation of the metastable γ" to a δ microstructure after homegenisation and ageing heat treatment at 800° C. for 1000 hours, in accordance with the present disclosure.

Referring again to FIG. 3, FIG. 3 shows a peak in the hardness of the alloys of the present disclosure may be obtained after an exposure of approximately 100 hours at 700° C. Importantly, the exposure of alloys according to the present disclosure for 1000 hours at 700° C. shows no marked deterioration in properties, demonstrating that the hardness may be retained during prolonged exposures at this temperature. As shown in FIG. 3, the hardness of the alloy after thermal exposure at 750° C. shows a similar behaviour to the material exposed at 700° C., but with a deficit across the range of times. Thermal exposure for 100 hours at 800° C. also results in a decline in hardness compared with the exposure of 10 hours at 800° C. This decline in properties is associated with precipitate coarsening as microstructural analysis indicated that the γ-γ'-γ" microstructure was retained. After exposure at 750° C. for 1000 hours, the onset of the thermodynamically stable δ phase was observed at the grain boundaries of the material. Furthermore, after 1000 hours at 800° C. or 100 hours at 900° C., extensive intergranular δ phase was observed, as shown in FIG. 4, FIG. 4 showing the microstructure resulting from a composition of Ni-15Cr-4Al-6Nb (comprising, in atomic percent, 15 percent Cr, 4 percent Al, 6 percent Nb, the balance consisting of Ni and incidental impurities) as specified in accordance with the present disclosure. The formation of the δ phase is associated with a decrease in alloy hardness and is therefore considered undesirable. For this reason, the alloys of the present disclosure are to be limited to a maximum service temperature of 750° C. due to a γ-γ'-γ" microstructure being retained below this temperature.

Figure 5:
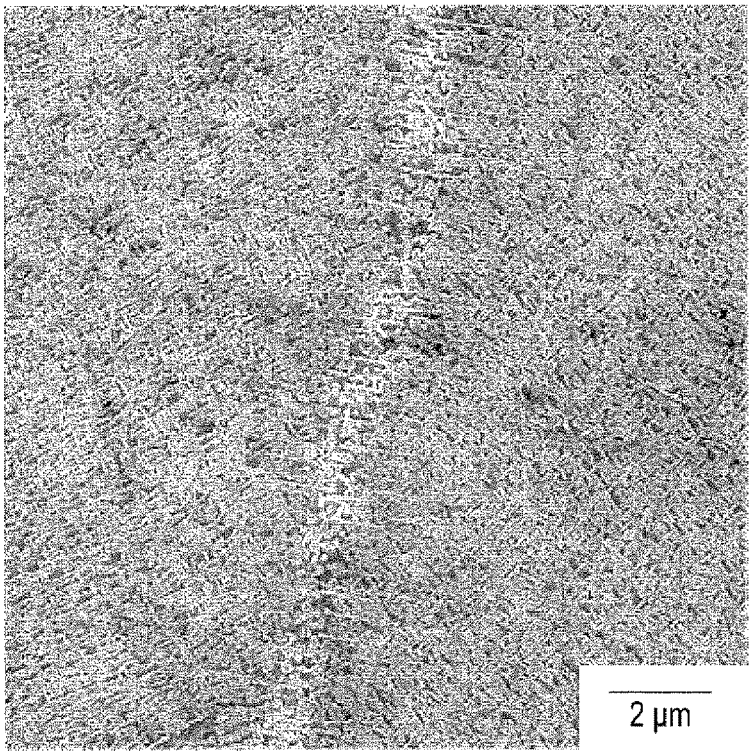
FIG. 5 shows a scanning electron micrograph of an alloy with the addition of 1 atomic percent titanium showing δ precipitation after heat treatment at 800° C. for 100 hours.

FIG. 5 shows an image of 6 precipitation in a Ni-15Cr-4Al-6Nb-1Ti alloy (comprising, in atomic percent, 15 percent Cr, 4 percent Al, 6 percent Nb and 1 percent Ti, the balance consisting of Ni and incidental impurities) which has been heat treated at 800° C. for 100 hours. In particular, and as shown in FIG. 5, including 1 at. % Ti (equivalent to about 0.75 wt. % Ti) in the alloy accelerates the degeneration of the microstructure, leading to precipitation of 6 phase after only 100 hours at 800° C. As such, additions of 1 at. % Ti to Ni-15Cr-4Al-6Nb are considered detrimental to the composition due to the precipitation of the undesired 6 phase or the agglomeration of precipitates when substituted for aluminium. Accordingly, titanium content is to be limited to a level equal to or below 0.2 at. % so as to maintain and preserve the desired γ-γ'-γ" microstructure and suppress the formation of the deleterious δ phase during exposure at temperatures of up to about 750° C.

Alloys of the present disclosure possess large temperature windows between the γ' solvus and the alloy solidus temperatures, typically in excess of 200° C. These large temperature windows facilitate the processing of these alloys, making them especially amenable to cast & wrought, powder metallurgy or additive manufacturing methods. As a result of the compositional range specified in accordance with this disclosure, along with the low γ' volume fractions obtained during processing, the alloys possess good weldability.

In particular, alloys according to the present disclosure preferably possess an atomic ratio of Al to the sum of Nb and Ta that is equal to or less than about 1 in order for the composition to form a stable γ-γ'-γ" microstructure. Should this not be the case, the composition may in some instances tend to form a solely γ-γ' microstructure, which may negate the inherent benefits conveyed by the γ" phase of alloys of the present disclosure.

Additionally, the atomic ratio of Al to the sum of Nb and Ta should preferably also be substantially equal to or greater than about 0.25, as lower values than this may over-saturate the alloy with niobium, which may in turn result in the preferred formation of δ, which may destabilise the alloy and negate the mechanical property benefits of the dual superlattice structure.

In accordance with alloys of the present disclosure, a minimum level of precipitate forming additions are required for the precipitation of the superlattice phases. The total addition of aluminium, niobium and tantalum should preferably be in excess of 7.5 at. percent, with tantalum not exceeding 3 at. percent. Furthermore, the total addition of aluminium, niobium and tantalum should preferably not exceed 12.5 at. percent as this will reduce the processability of the alloy. Maintaining the amount of matrix phase present also ensures that alloys in accordance with the compositional range specified allows a sufficient degree of ductility and damage tolerance. Preferably, the total addition of aluminium, niobium and tantalum should preferably be between 9 and 12.7 at. percent.

Examples of alloys in accordance with the present disclosure are presented in FIG. 7 (Table 2) which describes alloys that have been prepared and experimentally assessed in accordance with the present disclosure. The microstructure of Alloy '#1' following homogenisation and precipitate ageing heat treatments is shown in FIG. 1 and demonstrates the desired dual superlattice γ-γ'-γ" microstructure.

The concentrations of aluminium, niobium, tantalum and titanium in alloys in accordance with the present disclosure promote the formation of reinforcing precipitates γ', and/or the γ", which possess superlattice structures of the matrix, namely the $L1_2$ and $D0_{22}$ structures respectively (in Strukturbericht notation). Although the γ' and γ" are coherent with the γ matrix, there remains a degree of lattice misfit between the two phases that influences the morphology of the γ' precipitates. A low degree of misfit will favour the formation of spherical γ', whilst increasing levels of misfit will lead to cuboidal and eventually octahedral and octodendritic morphologies. Conversely the γ" is almost exclusively found with an elliptical, disc like, morphology. The coherent nature of the γ and the γ" with the γ matrix results in an orientation relationship of the two phases whereby:

$$(100)_{\gamma}//(100)_{\gamma'/\gamma''};[010]_{\gamma}//[010]_{\gamma'/\gamma''}$$

The composition of the γ' is nominally $Ni_3(Al, Ti)$, although niobium and tantalum possess some limited solubility. The γ' strengthened nickel-based superalloys retain strength to high temperature, allowing for their use in the hottest sections of the gas turbine engine. They also exhibit strong resistance to creep deformation and fatigue crack growth.

In particular, the γ" phase is based upon $Ni_3Nb$, and is typically present in commercial alloys, such as IN718, IN725 and René 220 in lower fractions than γ' strengthened alloys. Despite this reduced fraction of reinforcing phase, the γ" strengthened alloys have very high levels of strength, often beyond those of the γ' strengthened nickel-based superalloys, both under tensile and creep conditions. However, previous γ" strengthened alloys suffer a marked deterioration in mechanical properties at temperatures of 650° C. (1200° F.) and higher due to the transformation of the metastable γ" to the thermodynamically stable δ.

In accordance with tables 1 and 2, the elements included in the alloys of the present disclosure have been added for the reasons described below:

Aluminium promotes the formation of the γ' phase and confers improved oxidation resistance. It also serves to reduce the overall density of the alloys, thereby improving specific (density-corrected) properties and assisting in controlling the lattice misfit between the γ matrix and the γ' precipitates. In alloys of the present disclosure, atomic concentration of Al should preferably be substantially equal to or less than the atomic concentration of the sum and Nb and Ta to ensure a γ-γ'-γ" microstructure is produced. Higher Al concentrations favour the formation of γ-γ' microstructures, which do not have the additional benefits afforded by the γ" precipitates. Further, the overall Al concentration should be limited to ensure the γ' volume fraction does not result in compromised processability of the alloy and reduce its amenability to welding or additive manufacture. As a result of these constraints, the aluminium content of the alloys of this disclosure are limited to the range of 3<Al at. percent <5, and may preferably be in the range of 3.5<Al at. percent <4.5.

Titanium additions serve to confer significant strengthening to the γ' phase through solution strengthening and increasing the anti-phase boundary (APB) energy. However, it has been found that Ti cations have a deleterious effect upon the rate of $Cr_2O_3$ scale growth. In addition, titanium is associated with the accelerated formation of the unwanted η and δ phases in alloys of the present disclosure. Accordingly, titanium additions are therefore to be kept at a level that minimises the propensity for the precipitation of these undesired phases. As a result of these constraints, the titanium content of the alloys of this disclosure is limited to the range of 0<Ti at. percent <0.2.

Niobium additions serve to promote the formation of the γ" phase which is critical to the novel dual superlattice microstructure observed in this alloy. The precipitation of γ" in sufficient quantities necessitates a comparatively large concentration of Nb in the alloy. Nb additions also serve to increase the coherency strain between γ and γ', both of which offer benefits to mechanical strength. However, excess Nb will result in the accelerated precipitation of the deleterious δ phase and may compromise the environmental resistance of the alloy. As a result of these constraints, the niobium content of the alloys of this disclosure lie in the range 3<Nb at. percent <7.5, and may preferably be in the range of 5<Nb at. percent <6.5, wherein the aluminium to niobium atomic ratio is substantially equal to or less than about 1. Aluminium to niobium ratios greater than about 1 are known to result in the formation of microstructures comprising a γ matrix reinforced by γ' precipitates only [Mignanelli et al., Materials Science and Engineering A, 612, 2014, 179].

Tantalum additions, like titanium additions, serve to provide benefits to the alloy by strengthening the γ' precipitates through increasing the APB energy and also by stabilising the formation of MC carbides in the presence of carbon. However, the concentration of tantalum needs to be limited, as it is also known to participate in the formation of the unwanted η phase. Furthermore, lower concentrations of Ta reduce the density and minimise the cost of the alloy. The tantalum content of the alloys of this disclosure are therefore specified to lie in the range 0<Ta at. percent <3, and may preferably be in the range of 0<Ta at. percent <2.

Molybdenum is widely included in significant quantities in alloys of the prior art, typically in the range 2<Mo wt.

percent <9. This element is known to preferentially partition to the γ phase, where it acts as a potent solid solution strengthener, simultaneously increasing the lattice parameter of this phase and thereby also reducing the lattice misfit. However, this element has been found to strongly promote the formation of the G phase, which is considered deleterious for the mechanical and environmental performance of the alloys. In the present disclosure, the molybdenum content has been controlled to permit sufficient chromium to be added to provide suitable oxidation resistance, without compromising the stability of the alloy with respect to the σ phase. The concentration of molybdenum in alloys of the present disclosure have been specified to lie in the range of 0<Mo at. percent <3, and may preferably be in the range of 1<Mo at. percent <2 to balance the considerations mentioned above.

Tungsten additions serve to offer solid solution strengthening of both the γ and γ' phases and may be used to partially compensate for reduced molybdenum levels in the γ phase. However, with tungsten additions in excess of 1.5 at. percent, alloy stability may become compromised with respect to the formation of the μ phase. In addition, high levels of tungsten adversely affect the overall density of the alloy. The compositions of alloys of the present disclosure are therefore limited to the range 0<W at. percent <2, and may preferably be in the range of 0<W at. percent <1.

Chromium additions serve to allow the formation of a chromium (III) oxide scale to provide environmental resistance. The chromium concentration range specified in the present disclosure of 15<Cr at. percent <25, which may preferably be in the range of 17<Cr at. percent <22, has been chosen to ensure that suitable environmental resistance is achieved without unduly compromising the stability of the alloy towards the formation of undesirable TCP phases. Chromium also offers limited solid solution strengthening of the γ phase.

Cobalt is known to be effective in lowering the stacking fault energy (SFE) of the γ phase. This allows the partial dislocations that control plastic deformation in this phase to become more widely separated, thereby restricting cross slip of dislocations and offering improved strength, creep and fatigue properties. Accordingly, cobalt has been limited to 0<Co at. percent <16, which may preferably be 0<Co at. percent <4, as there is no evidence at present that higher concentrations confer additional benefits to these alloys.

Iron may optionally be added to the alloys to confer additional solid solution strengthening and reduce alloy cost. Iron has therefore been limited to 0<Fe at. percent <8, which may preferably be 0<Fe at. percent <1.5.

Prior research has suggested that additions of manganese or silicon may modify the oxidation and hot corrosion resistance of superalloys. However, it is recognised that silicon additions promote the formation of σ phase, which requires that the chromium content in the alloy be reduced to maintain a stable microstructure. This potentially limits any benefit that may be derived from adding silicon. Manganese, at levels of 0 to 0.6 at. percent, has been previously shown (U.S. Pat. No. 4,569,824) to improve both the corrosion resistance of polycrystalline nickel alloys at temperatures between 650-760° C. as well as the creep properties. As a result of these constraints, the Manganese and Silicon content of the alloys of this disclosure each lie in the range 0.0<Mn at. percent <1.0, and 0.0<Si at. percent <1.0 respectively.

In the alloys of the present disclosure, a carbon concentration between 0<C at. percent <0.5 has been specified, which may preferably be 0<C at. percent <0.4. It has previously been shown that 0.03 wt. percent carbon minimizes internal oxidation damage from decomposition of $M_{23}C_6$ carbides. However, more effective control of grain growth through grain boundary pinning during super-solvus solution heat treatments is achieved with a carbon concentration of circa 0.05 wt. percent. It is understood that higher carbon concentrations produce; smaller average grain sizes; narrower grain size distributions; and, lower As Large As (ALA) grain sizes. This is significant as yield stress and fatigue endurance at intermediate temperatures (<650° C.) are highly sensitive to grain size.

It has been found that appropriate additions of zirconium (in the region of 0.02-0.1 wt. percent) and boron (in the region of 0.02-0.032 wt. percent) are required to optimise the resistance to intergranular crack growth from high temperature dwell fatigue cycles.

In the development of both cast and forged polycrystalline superalloys for gas turbine applications, zirconium is known to improve high temperature tensile ductility, strength and creep resistance. Zirconium also scavenges oxygen and sulphur at grain boundaries, forming small zirconium oxide or sulfide particles. This provides improved grain boundary cohesion and potential barriers to grain boundary diffusion of oxygen.

It is known that boron promotes the precipitation of $M_3B_2$ boride particles on the grain boundaries that are believed to be beneficial to dwell crack growth resistance. The concentration of boron should be at a level that ensures that there are sufficient particles on the grain boundaries to minimise grain boundary sliding during dwell fatigue cycles as well as providing barriers to stress assisted diffusion of oxygen. It is also understood that elemental boron may improve grain boundary cohesion. However, boron can be detrimental if added in sufficient quantities to form continuous grain boundary films.

Accordingly, zirconium content has been limited to 0<Zr at. percent <0.07, and boron to 0<B at. percent <0.175 respectively.

Hafnium is a potent MC carbide forming element. However, as with zirconium, hafnium also serves to scavenge oxygen and sulphur. With hafnium concentrations in excess of 0.4 wt. percent, hafnium may also be incorporated into the γ', increasing the γ' solvus temperature and improving strength and resistance to creep strain accumulation. However, hafnium's affinity for oxygen is such that hafnium oxide particles/inclusions may be produced during melt processing of the alloy. These melt anomalies need to be managed, and the issues associated with their occurrence should be balanced against the likely benefits. Hence, until such time as control over the melt anomalies is achieved, no hafnium is desired in alloys of the present disclosure. As such, hafnium levels within the alloy are limited to 0<Hf at. percent <0.2.

The concentrations of the trace elements sulphur and phosphorous should be minimised to promote good grain boundary strength and maintain the mechanical integrity of oxide scales. It is understood that levels of sulphur and phosphorous less than 5 and 20 ppm respectively are achievable in large production size batches of material. However, it is anticipated that the benefits of the disclosure would still be achieved, provided the level of sulphur is less than 20 ppm and phosphorous less than 60 ppm. Although, in these circumstances, it is likely that the resistance to oxide cracking would be reduced.

The disclosure therefore provides a range of nickel base alloys particularly suitable for additive manufacture of high-temperature structures including, for example combustor or turbine casings. Components manufactured from these alloys will have a balance of material properties that will allow them to be used at significantly higher temperatures than existing alloys. In contrast to known alloys, the alloys according to the disclosure achieve a better balance between resistance to environmental and microstructural degradation and high temperature mechanical properties such as proof strength, resistance to creep strain accumulation, dwell fatigue and damage tolerance. This permits the alloys according to the disclosure to be used for components operating at temperatures up to 750° C., in contrast to known alloys of similar processability, which are limited to temperatures of up to 650° C.

Although the alloys according to the disclosure are particularly suitable for additive manufactured components in gas turbine engines, it will be appreciated that they may also be used in other applications and may be amenable to fabrication using other routes, including cast & wrought or powder metallurgy processing.

As compressor discharge temperatures and turbine entry temperatures increase over time, to promote improvements in thermal efficiency and thereby in fuel consumption, the temperature of the static components of the combustor and turbine will necessarily also increase. Alloys of the present disclosure would therefore be particularly suitable for combustor or turbine components that would benefit from the expected improvements in temperature capability and microstructural stability over existing alloys that are similarly processable. The amenability of the alloys of the present disclosure to processing using additive manufacturing is considered particularly valuable as it enables additional benefits to be achieved through the manufacture of components with very complex geometries or by either reducing the amount of material required and/or the time required to manufacture the component.

While the disclosure has been described in terms of particular embodiments, including particular compositions and properties of nickel-base superalloys, the scope of the disclosure is not so limited. Instead, the scope of the disclosure is to be limited only by the following claims.

The invention claimed is:

1. A nickel-base alloy consisting of, in atomic percent unless otherwise stated: up to 8 percent Fe, up to 16 percent Co, between 15 and 25 percent Cr, up to 3 percent Mo, up to 2 percent W, between 3 and 5 percent Al, between 3 and 7.5 percent Nb, up to 3 percent Ta, up to 0.2 percent Ti, up to 0.5 percent C, up to 0.175 percent B, up to 0.07 percent Zr, up to 1 percent Mn, up to 1 percent Si, up to 0.2 percent Hf; the balance consisting of Ni and incidental impurities; wherein, the atomic ratio of Al to Nb is between 0.4 and 1.7; and, the atomic ratio of the sum of Al and Ti to Nb is between 0.4 and 1.8.

2. A nickel-base alloy according to claim 1, the composition comprising at least 9 percent of elements from the group consisting of Al, Nb, and Ti.

3. A nickel-base alloy according to claim 2, the composition comprising between 9 and 12.7 percent of elements from the group consisting of Al, Nb, and Ti.

4. A nickel-base alloy according to claim 1, wherein the atomic ratio of the sum of Al and Ta to Nb is between 0.4 and 2.7.

5. A nickel-base alloy according to claim 1, wherein the atomic ratio of Al to the sum of Nb and Ta is between 0.2 and 1.7.

6. A nickel-base alloy according to claim 1, the microstructure comprising a γ matrix strengthened by both γ' and γ" precipitates.

7. A nickel-base alloy consisting of, in atomic percent unless otherwise stated: up to 1.5 percent Fe, up to 4 percent Co, between 17 and 22 percent Cr, between 1 and 2 percent Mo, up to 1 percent W, between 3.5 and 4.5 percent Al, between κ and 6.5 percent Nb, up to 2 percent Ta, up to 0.2 percent Ti, up to 0.4 percent C, up to 0.175 percent B, up to 0.07 percent Zr, up to 1 percent Mn, up to 1 percent Si, up to 0.2 percent Hf; the balance consisting of Ni and incidental impurities.

8. A nickel-base alloy according to according to claim 7, the composition comprising an atomic ratio of Al to Nb which is less than 1.

9. A nickel-base alloy according to claim 7, the composition comprising an atomic ratio of the sum of Al and Ti to Nb which is between 0.5 and 1.

10. A nickel-base alloy according to claim 7, the composition comprising at least 9 percent of elements from the group consisting of Al, Nb, and Ti.

11. A nickel-base alloy according to claim 7, the composition comprising between 9 and up to 11.2 percent of elements from the group consisting of Al, Nb, and Ti.

12. A nickel-base alloy according to claim 7, the composition comprising between 8.5 and up to 11 percent of elements from the group consisting of Al and Nb.

13. A nickel-base alloy according to claim 7, the composition comprising between 8.5 and up to 13 percent of elements from the group consisting of Al, Nb, and Ta.

14. A nickel-base alloy according to claim 7, wherein the atomic ratio of the sum of Al and Ta to Nb is between 0.5 and 1.3.

15. A nickel-base alloy according to according to claim 7, the composition comprising an atomic ratio of Al to Nb which is between 0.5 and 0.9.

16. A nickel-base alloy according to claim 7, wherein the atomic ratio of Al to the sum of Nb and Ta is between 0.25 and 1.

* * * * *